US006290418B1

(12) United States Patent
Frey

(10) Patent No.: US 6,290,418 B1
(45) Date of Patent: Sep. 18, 2001

(54) CONTAINER AND METHOD

(76) Inventor: John Frey, 1011 N. Cummings Dr., Alvarado, TX (US) 76009

( * ) Notice: Subject to any disclaimer, the term of this patent is extended or adjusted under 35 U.S.C. 154(b) by 0 days.

(21) Appl. No.: 09/777,319

(22) Filed: Feb. 6, 2001

(51) Int. Cl.[7] ..... A46B 11/00
(52) U.S. Cl. ..... 401/126; 401/7; 401/127
(58) Field of Search ..... 401/126, 127, 401/130, 7, 118; 215/228, 231, 391; 220/212, 735

(56) References Cited

U.S. PATENT DOCUMENTS

| | | | | |
|---|---|---|---|---|
| 1,608,449 | * | 11/1926 | Wendel | 401/130 |
| 2,738,537 | | 3/1956 | Rotheraine | 15/258 |
| 2,790,982 | * | 5/1957 | Schneider | 401/7 |
| 2,839,774 | | 6/1958 | Rand | 15/258 |
| 3,299,464 | | 1/1967 | O'Brien et al. | 15/506 |
| 3,558,022 | * | 1/1971 | Zytke | 401/126 |
| 4,715,496 | | 12/1987 | Hackmann | 206/229 |
| 5,045,073 | * | 9/1991 | Wagner | 401/7 |
| 5,255,812 | * | 10/1993 | Hsu | 220/212 |

* cited by examiner

*Primary Examiner*—David J. Walczak

(57) ABSTRACT

A container for dispensing a viscous agent. The container includes a lid with an upper planar surface having an opening therein. A prophylactic sheath depends from the opening and has an extendable body, a normally open interior and end opening which defines a mouth region. The mouth region is affixed to the lid in proximity to the border of the lid opening. The user can insert one or more fingers within the end opening to extend the sheath for dispensing a viscous agent from the body of the container during use. The sheath can also be afixed to an insert which is installed within the mouth opening of the container.

10 Claims, 2 Drawing Sheets

FIG. 1
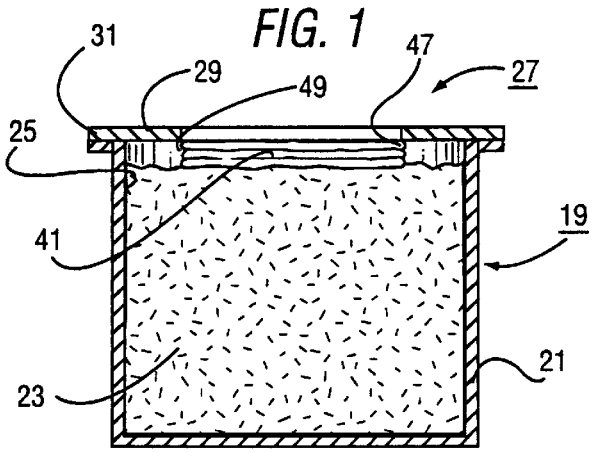
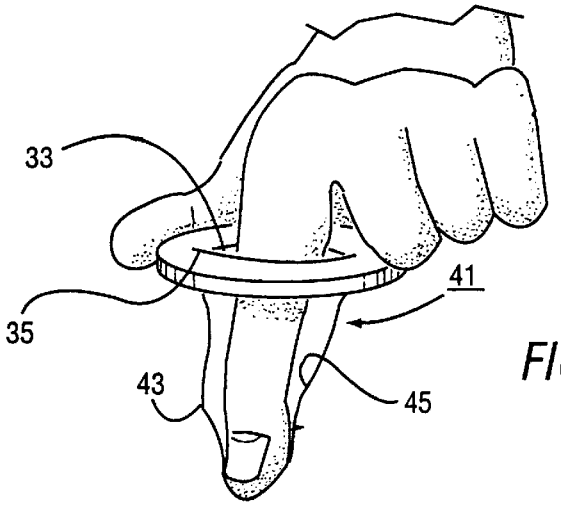
FIG. 2
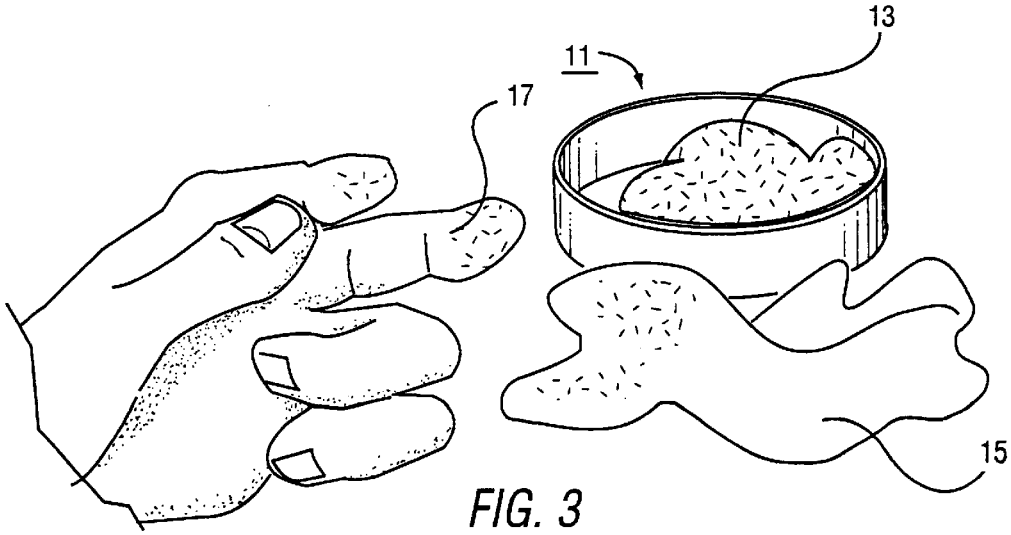
FIG. 3
Prior Art

FIG. 4
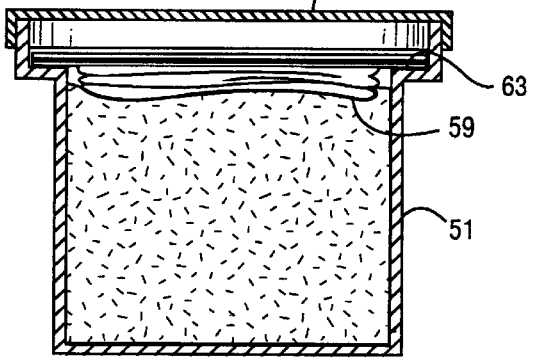
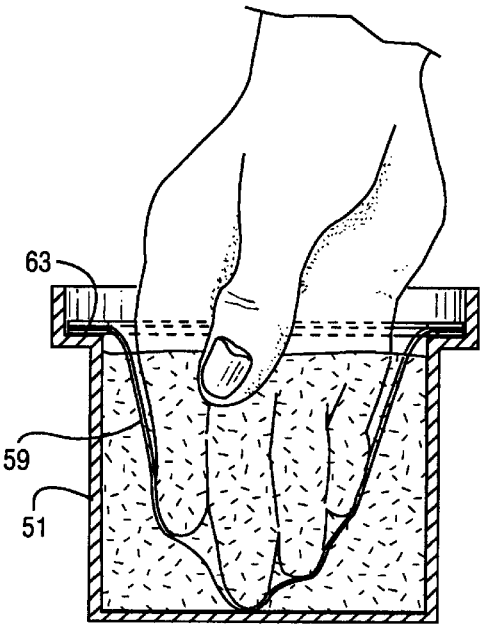
FIG. 6
FIG. 5
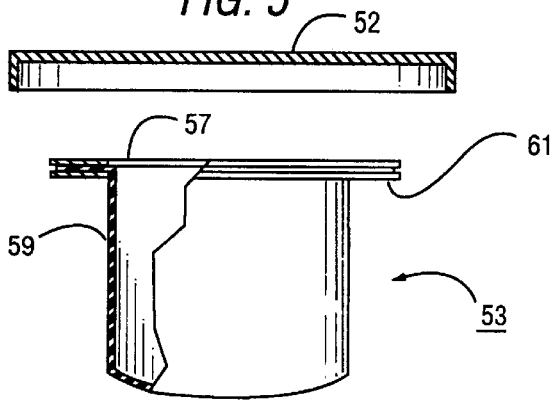
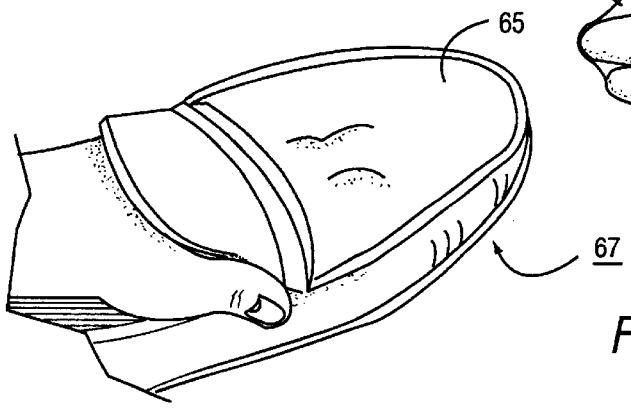
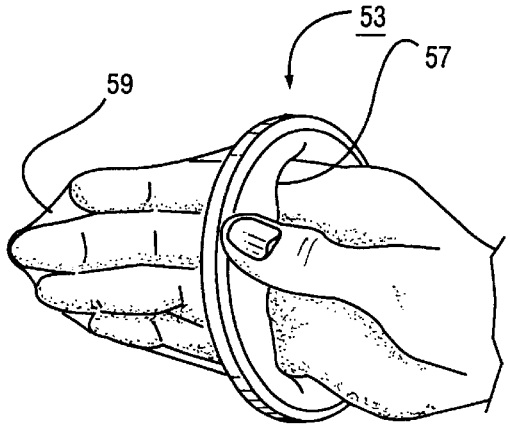
FIG. 7

CONTAINER AND METHOD

BACKGROUND OF THE INVENTION

1. Field of the Invention

The present invention relates to containers for dispensing viscous, solid and semi-solid agents and, more specifically, to an improved lid and method for dispensing such agents from a container.

2. Description of the Prior Art

A variety of containers are known in the art for dispensing viscous agents of various kinds. These agents include waxes, pastes, polishes, greases, and the like. For example, people who are concerned with the appearance of their shoes often wish to use a paste-type wax as opposed to liquid polishes. The paste-type polish or wax usually comes within a small can or bottle with a lid. Even if a polish cloth is used to dab the polish from the container and apply it to the shoe, the polish often contacts the user's hand and is difficult to remove and is messy.

Other types of containers are used to dispense, for example, grease such as is used to pack the wheel bearing of an automobile, "VASELINE", or other medicinal agents which exist in the viscous or semi-solid state. In each case, it is generally necessary for the user to either use a glove, rag, or accessory brush with the end result being that the user's hand often contacts the composition, even if care is exercised.

A need exists for a container for dispensing viscous agents of the above type which eliminates the need for a rag, brush or other accessory for dispensing the agent.

A need also exists for such a container with an integral accessory which effectively isolates the user's hand from the agent being dispensed.

A need also exists for such a container accessory which is reusable for multiple dispensing operations.

A need also exists for such a container with a dispensing accessory which is incorporated within the lid itself.

A need exists for such an improved container which is simple in design and which is economical to manufacture.

SUMMARY OF THE INVENTION

A container is shown for dispensing viscous agents which includes a container body for receiving the viscous agent. A lid is provided for the container body. The lid has an upper planar surface with an outer periphery, the outer periphery defining a peripheral lip for engaging the container body. The upper planar surface of the lid has at least one opening therein defined by a border of a size sufficient to receive a finger of a user. A prophylactic sheath depends from the lid. The sheath has an extendable body, a normally open interior and an end opening which defines a circumferential mouth region. The mouth region is affixed to the lid in proximity to the border of the lid opening, whereby the insertion of the finger of a user within the end opening will extend the sheath during use.

Preferably, the prophylactic sheath is formed of latex rubber and is bonded or otherwise securely affixed to the lid. The viscous agent can be selected from the group consisting of waxes, pastes, polishes, and greases.

In the method of the invention, the container with the previously described lid has a viscous agent present within the open interior. The lid is first removed from the container. The user then inserts a finger through the end opening of the prophylactic sheath to extend the body thereof. An exterior surface of the extended sheath is used to contact the viscous agent in the container body so that a desired amount of agent adheres to the sheath. The agent is applied to a work surface by rubbing the sheath across the surface. As the user withdraws the finger from the sheath end opening, the sheath is allowed to return from the extended position to a collapsed position and the lid can be replaced on the container.

In another form of the invention, the container is provided with a normal container lid. An insert is received within the container body when the lid is in place. The insert has an upper planar surface with an outer periphery, the outer periphery defining a peripheral lip and wherein the upper planar surface of the insert has at least one opening therein defined by a border of a size sufficient to receive a finger of a user. The prophylactic sheath depends from the opening provided in the insert in the same way as previously described with respect to the lid opening. The container can be provided with an internal shelf with the insert peripheral lip being received upon the shelf when in place within the container body.

Additional objects, features and advantages will be apparent in the written description which follows.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

FIG. 1 is a side, partial cross-sectional view of a container of the invention showing the improved lid thereof;

FIG. 2 is a perspective view illustrating the use of the improved lid of the invention, the finger of a user being inserted within the depending prophylactic sheath thereof;

FIG. 3 is a perspective view of a prior art container showing a user dispensing a viscous agent therefrom;

FIG. 4 is a side, partial cross-sectional view, similar to FIG. 1 but showing another container of the invention with an insert provided within the container body;

FIG. 5 is an exploded view of the container, lid and insert of FIG. 4;

FIG. 6 is a side view, similar to FIG. 4, showing the user's hand inserted within the prophylactic sheath which depends from the container insert; and FIG. 7 is a perspective view of a user's hand using the container insert of the container of FIG. 4 to dispense shoe polish onto a shoe.

DETAILED DESCRIPTION OF THE INVENTION

Turning first to FIG. 3, there is a shown a prior art container 11 for dispensing a viscous agent 13, in this case, a shoe polish composition. It was generally necessary for the user to utilize a rag 15 to dab a certain amount of polish onto the shoe to be polished. The general result was that at least some of the polish ended upon the fingers 17 of the user's had.

The container of the invention has as its object to provide an improved lid having an integral dispensing aid for dispensing viscous agents such as shoe polish, polishes, waxes, greases, pastes, and the like. Although the particular embodiment illustrated in the drawings is a shoe polish container, it will be readily understood by those skilled in the art that containers of the present type can be easily adapted for use with greases used to pack automobile bearings, medicinal agents such as "VASOLINE", and the like. Any viscous, solid, semi-solid or even sufficiently thick liquid agent can be dispensed without danger of contaminating the user's finger or fingers.

Turning to FIGS. 1 and 2, there is shown an improved container of the invention designated generally as 19. The improved container 19 includes a container body 21 for receiving the viscous agent 23. The container body 21 has a mouth opening 25.

A lid 27 for forming a sealed enclosure with the container body is provided for the container body 21. The lid has an upper planar surface 29 and an outer periphery which defines a peripheral lip 31. As shown in FIG. 1, the peripheral lip 31 is adapted to engage the mouth opening 25 of the container body 21.

As shown in FIGS. 1 and 2, the upper planar surface 29 of the lid has at least one opening 33 therein defined by a border 35 of a size sufficient to receive at least one finger of a user. A prophylactic sheath 41 depends from the lid. The sheath has an extendable body 43, a normally open interior 45 and an end opening 47 (FIG. 1) which defines a circumferential mouth region 49. The mouth region 49 is affixed to the lid in proximity to the border of the lid opening, whereby the finger of a user being inserted within the end opening will extend the sheath during use (FIG. 2).

The prophylactic sheath can be formed of any convenient flexible resilient material such as a convenient rubber or plastic. Preferably, the prophylactic sheath is formed of latex rubber. The sheath 41 can be affixed to the lid opening in any convenient manner. For example, commercially available techniques for bonding rubber to metal, plastic or other rigid substrates include:

(1) embossing the two materials (for example, foil stamping of aluminum alloys to neoprene or latex is known in the art);

(2) sonically sealing the two materials;

(3) mold insertion—this technique is used with certain filter media in which the media is placed in a mold with a short plastic region around the media, typically Teflon, the materials being adhered within the mold;

(4) stamping—significant pressure creates a homogeneous effect between the rubber and metal or plastic.

Although the sheath 41 is illustrated in the drawings as being a simple latex balloon shaped body, it will be understood that more complex shapes can be utilized as well. For example, the sheath body could be formed as an "accordion shaped" expandable element (not shown) . The accordion regions or folds could be impressed in the rubber of the element during molding. The element would normally be flat and relaxed but could be expanded to unfold the accordion regions by inserting the user's finger, as shown in FIG. 2.

FIG. 4 illustrates another embodiment of the invention in which the container body 51 is provided with a conventional lid 52 but which houses an insert 53 (FIG. 5) which contains the opening 57 and depending prophylactic sheath 59. The insert peripheral edge 61 is received upon a ledge 63 (FIG. 4) provided within the container body for supporting the insert. Thus, the insert 53 contains the prophylactic sheath, rather than the sheath being incorporated directly within the lid itself.

In the method of the invention illustrated in FIG. 7, the finger or fingers of the user are inserted through the end opening (in this case opening 57) of the prophylactic sheath 59 to extend the body thereof. The body of the sheath 59 is used to contact a viscous agent such as the polish 13 in FIG. 3 so that a desired amount agent adheres to the sheath. The agent is then applied to a work surface such as the toe region 65 of the shoe 67 by rubbing the sheath across the surface. Once the desired amount of polish has been applied, the user's fingers are withdrawn from the sheath end opening, thereby allowing the sheath to return from the extended position shown in FIG. 7 to the collapsed position shown in FIG. 4. The lid can then be replaced on the container.

An invention has been shown with several advantages. The container and container lid of the invention allow a viscous agent to be dispensed without contaminating the user's fingers. In the case of a polish, this prevents the fingers from becoming messy and contaminated. In the case of a medicinal agent, the user's fingers are isolated from the active ingredients. The device can be used for dispensing a variety of viscous agents including waxes, pastes, polishes, medicinal agents, solid, semi-solid and even thick liquid compositions. The container design is simple and economical to manufacture.

While the invention has been shown in only two of its forms, it is not thus limited but is susceptible to various changes and modifications without departing from the spirit thereof.

I claim:

1. A container for dispensing a viscous agent, the container comprising:

a container body for receiving the viscous agent;

a lid for the container body, the lid having an upper planar surface with an outer periphery, the outer periphery defining a peripheral lip for engaging the container body and wherein the upper planar surface of the lid has at least one opening therein defined by a border of a size sufficient to receive a finger of a user; and a prophylactic sheath depending from the lid, the sheath having an extendible body, a normally open interior and an end opening which defines a circumferential mouth region, the mouth region being affixed to the lid in proximity to the border of the lid opening, whereby the finger of a user being inserted within the end opening will extend the sheath during use.

2. The container of claim 1, wherein the prophylactic sheath is formed of latex rubber.

3. The container of claim 1, wherein the viscous agent is selected from the group consisting of polishes, waxes, pastes and greases.

4. The container of claim 1, wherein the sheath is affixed to the lid by embossing the two materials.

5. The container of claim 1, wherein the sheath is affixed to the lid by sonically sealing the two materials.

6. The container of claim 1, wherein the prophylactic sheath is stamped to the lid to create a homogeneous effect.

7. The container of claim 1, wherein the prophylactic sheath is molded by plastic injection in a mold to the material of the lid.

8. A method of dispensing a viscous agent from a container having a container body which receives the agent and a lid for forming a sealed enclosure with the container body, the method of comprising the steps of:

providing an opening in an upper planar surface of the lid, the opening being defined by a border of a size sufficient to receive at least one finger of a user;

affixing a prophylactic sheath to the lid opening, the sheath having an extendible body, a normally open interior and end opening which defines a circumferential mouth region, the mouth region being affixed to the lid in proximity to the border of the lid opening, whereby the finger of a user being inserted within the end opening will extend the sheath during use;

removing the lid from the container;

inserting a finger of a user through the end opening of the prophylactic sheath to extend the body thereof;

contacting an exterior surface of the extended sheath with the viscous agent in the container body so that a desired amount of agent adheres to the sheath;

applying the agent to a work surface by rubbing the sheath across the surface;

withdrawing the user's finger from the sheath end opening, thereby allowing the sheath to return from the extended position to a collapsed position; and the lid on the container.

9. A container for dispensing a viscous agent, the container comprising:

a container body for receiving the viscous agent;

a lid for the container body;

an insert received within the container body when the lid is in place, the insert having an upper planar surface with an outer periphery, the outer periphery defining a peripheral lip and wherein the upper planar surface of the insert has at least one opening therein defined by a border of a size sufficient to receive a finger of a user; and a prophylactic sheath depending from the insert, the sheath having an extendible body, a normally open interior and an end opening which defines a circumferential mouth region, the mouth region being affixed to the insert in proximity to the border of the insert opening, whereby the finger of a user being inserted within the end opening will extend the sheath during use.

10. The container of claim 9, wherein the container has an internal shelf and wherein the insert peripheral lip is received upon the shelf when in place within the container body.

* * * * *